US007166171B2

(12) United States Patent
Kim

(10) Patent No.: US 7,166,171 B2
(45) Date of Patent: Jan. 23, 2007

(54) LONGITUDINAL MAGNETIC FIELD COMPACTING METHOD AND DEVICE FOR MANUFACTURING RARE EARTH MAGNETS

(75) Inventor: Dong-Hwan Kim, Cheongju-si (KR)

(73) Assignee: Jahwa Electronics Co., Ltd. (KR)

( * ) Notice: Subject to any disclaimer, the term of this patent is extended or adjusted under 35 U.S.C. 154(b) by 376 days.

(21) Appl. No.: 10/620,399

(22) Filed: Jul. 16, 2003

(65) Prior Publication Data

US 2005/0257855 A1 Nov. 24, 2005

(30) Foreign Application Priority Data

Apr. 2, 2003 (KR) ..... 10-2003-0020869

(51) Int. Cl.
*H01F 1/032* (2006.01)
*H01F 1/057* (2006.01)

(52) U.S. Cl. ..... 148/103; 148/101; 419/12; 419/29; 419/23; 419/33

(58) Field of Classification Search ..... None
See application file for complete search history.

(56) References Cited

U.S. PATENT DOCUMENTS 4,134,495 A * 1/1979 Friedman ..... 206/387.11
5,250,255 A * 10/1993 Sagawa et al. ..... 419/39
5,666,635 A * 9/1997 Kaneko et al. ..... 419/12
6,770,242 B2 * 8/2004 Billiet et al. ..... 419/33
2005/0133117 A1 * 6/2005 Tayu et al. ..... 148/105

* cited by examiner

*Primary Examiner*—John P. Sheehan
(74) *Attorney, Agent, or Firm*—Daniel P. Burke & Associates, PLLC

(57) ABSTRACT

Disclosed is a longitudinal magnetic field compacting method and device for manufacturing a neodymium (Nd) based rare earth magnet in the shape of a butterfly for use in VCM of HDD or DVD, a disk or coin for use in coreless motors, and a block for use in linear motors, characterized in that a longitudinal compacting process is performed under a pulse magnetic field for orientation of rare earth powders in the direction of an applied magnetic field. Further, a compacted body of the rare earth powders has the same shape as end products, thus no additional processing cost, thereby lowering manufacturing costs. In addition, the rare earth powders can be subjected to an aligning process and a longitudinal compacting process at the same time under the high pulse magnetic field of 50–70 kOe, whereby the resulting rare earth magnet can have excellent magnetic properties of 42–50 MGOe.

12 Claims, 1 Drawing Sheet

LONGITUDINAL MAGNETIC FIELD COMPACTING METHOD AND DEVICE FOR MANUFACTURING RARE EARTH MAGNETS

BACKGROUND OF THE INVENTION

1. Field of the Invention

The present invention relates, in general, to longitudinal magnetic field compacting methods and devices for manufacturing high performance rare earth sintered magnets having butterfly shapes for use in VCM (Voice Coil Motor) of HDD (Hard Disk Drive) or DVD (Digital Versatile Disk), disk or coin shapes for use in coreless motors, and block shapes for use in linear motors.

More particularly, the present invention is directed to a longitudinal magnetic field compacting method and device for manufacturing neodymium (Nd) based rare earth sintered magnets, characterized in that a longitudinal compacting process is used under a pulse magnetic field so that rare earth powders are oriented in a direction of an applied magnetic field, whereby the rare earth sintered magnet can be fabricated in the shape of a butterfly for VCM of HDD or DVD and a disk or coin for coreless motors with superior magnetic properties, as well as a block for linear motors. Further, compared to conventional longitudinal compacting methods using a static magnetic field, a compacted body of the present invention has the same shape as end products, and there is no additional processing cost, thereby lowering manufacturing costs. In addition, the rare earth powders can be subjected to an aligning process and a longitudinal compacting process at the same time under the high pulse magnetic field of 50–70 kOe. Thereby, the resulting rare earth magnet can have magnetic properties of 42–50 MGOe better than those fabricated by conventional transverse static magnetic field compacting methods. Consequently, the longitudinal compacting method and device of the present invention can be effectively used, therefore realizing high practical applicability.

2. Description of the Related Art

With great advances in magnetic techniques, there have been required rare earth sintered magnets in the shape of a butterfly for use in VCM of HDD or DVD, a disk or coin for use in coreless motors, and a block for use in linear motors, with a maximum magnetic energy product of 40–49 MGOe.

In order to manufacture the rare earth magnet with excellent magnetic properties (maximum magnetic energy product), an aligning process and a magnetic field compacting process of rare earth powders in a direction of an applied magnetic field should be improved. Examples of conventionally used magnetic field compacting methods include a longitudinal compacting method and a transverse compacting method both using a static magnetic field.

As for such a longitudinal static magnetic field compacting method, rare earth powders having a particle size of 2–6 μm are packed in a metal mold having a cavity with a predetermined shape, to which the static magnetic field of 10–20 kOe is applied, thus aligning the powders in the direction of an applied magnetic field (anisotropic). Then, a direction of an applied compacting pressure is applied to be coincident with the direction of the applied magnetic field. In such a case, the alignment of the rare earth powders is performed by generating a static magnetic field with the use of an electromagnet, which is fabricated by winding a coil around an iron core. However, electromagnets have limitations in that the strength of the magnetic field has a maximum of 30 koe. Accordingly, the conventional longitudinal compacting method using the static magnetic field is disadvantageous in terms of the fabrication of the magnet with a degree of orientation of 89%. As such, the value of the maximum magnetic energy product, which is in proportion to product of such a degree of orientation, is 42 MGOe. Consequently, the magnet fabricated by the longitudinal static magnetic field compacting method suffers from relatively low magnetic properties.

In addition, in the case of the transverse static magnetic field compacting method, the direction of an applied compacting pressure is perpendicular to the direction of the applied magnetic field. Upon the transverse compacting, the degree of orientation of the powders is increased to 93%, thus obtaining the magnetic properties of 46 GMOe. However, it is impossible to compact the rare earth powders to butterfly-shaped, and disk- or coin-shaped magnets with superior magnetic properties of 42 GMOe or higher. Hence, the rare earth powders are compacted and sintered in the shape of a block or arc, and then processed to the desired shape of end products. Therefore, manufacturing costs increase.

As a result, limitations are imposed on the efficiency of conventional longitudinal and transverse compacting methods using a static magnetic field, and thus practical applicability thereof is minimized.

SUMMARY OF THE INVENTION

Accordingly, the object of the present invention is to alleviate the problems encountered in the related art and to provide a longitudinal magnetic field compacting method and device for manufacturing neodymium. (Nd) based rare earth sintered magnets, characterized in that a longitudinal compacting process is used under a pulse magnetic field so that rare earth powders are oriented in the direction of an applied magnetic field, whereby a high performance rare earth sintered magnet can be manufactured in the shape of a butterfly for use in VCM of HDD or DVD and a disk or coin for coreless motors with excellent magnetic properties, as well as a block for use in linear motors. Further, compared to conventional longitudinal compacting methods using a static magnetic field, a compacted body of the rare earth powders of the present invention has the same shape as end products, thus requiring no additional processing cost, whereby manufacturing costs are lowered.

Another object of the present invention is to provide a longitudinal magnetic field compacting method and device, in which rare earth powders can be subjected to an aligning process and a longitudinal compacting process at the same time under a high pulse magnetic field of 50–70 kOe, thereby obtaining a rare earth magnet with superior magnetic properties of 42–50 MGOe, compared to magnets fabricated by conventional transverse static magnetic field compacting methods.

Still another object of the present invention is to provide a longitudinal magnetic field compacting method and device, having high practical applicability due to an improved efficiency thereof.

BRIEF DESCRIPTION OF THE DRAWING

The above and other objects, features and other advantages of the present invention will be better understood from the following detailed description taken in conjunction with the accompanying drawing, in which.

DETAILED DESCRIPTION OF THE INVENTION

Figure 1:
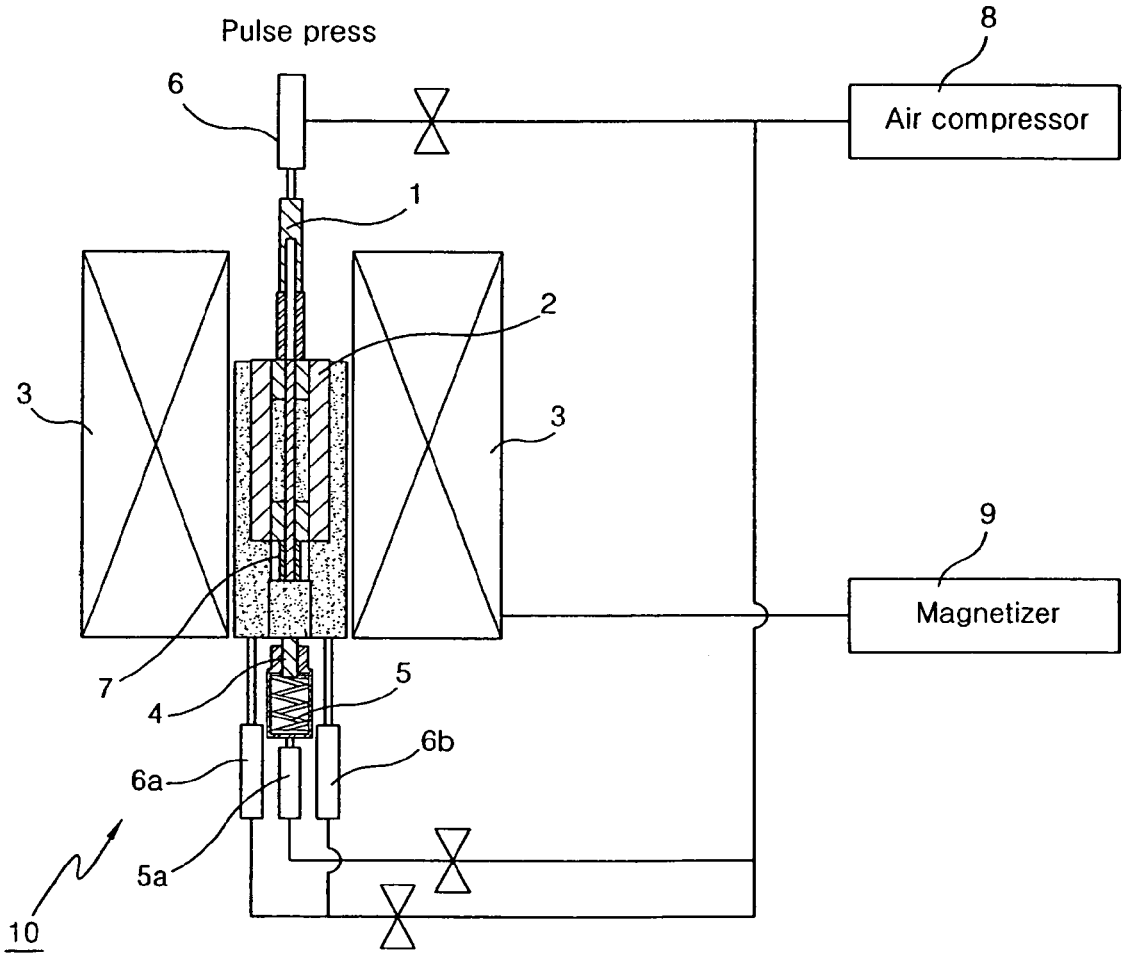
FIG. 1 is a schematic view illustrating a longitudinal magnetic field compacting device of the present invention.

In the present invention, a specific description for the related techniques or structures is considered to be unnecessary and thus is omitted.

Further, it should be understood that the terminology used therein is for the purpose of describing particular embodiments only and is not intended to be limiting.

Based on the present invention, there is provided a longitudinal magnetic field compacting method for manufacturing a rare earth sintered magnet in the shape of a butterfly for use in VCM of HDD or DVD, a disk or coin for use in coreless motors, and a block for linear motors. The longitudinal compacting method includes the step of melting an alloy of 27–36 wt % RE/59–73 wt % Fe/0–5 wt % TM/0–2 wt % B (wherein, RE means a rare earth element, and TM means a 3d transition metal) by a vacuum induction heating process, to obtain a molten alloy, which is then subjected to a strip casting process or a chill mold casting process, to prepare an alloy ingot. Further, the method has the steps of hydrogenating the alloy ingot in a range of room temperature to 200° C. to increase pulverizability of the alloy ingot, followed by uniformly and finely pulverizing the alloy ingot by means of a jet mill, an attritor mill, a ball mill or a vibration mill, to prepare rare earth powders having a particle size of 2–6 μm. Thusly pulverized rare earth powders are applied with a pulse magnetic field, so that the rare earth powders are oriented in a direction of an applied magnetic filed. As well, the rare earth powders are subjected to a longitudinal compacting, based on the principle that a magnetic material is attracted to a center of a magnetic field coil by the pulse magnetic field, to form a compacted body. Then, such a compacted body is sintered at 1000–1100° C. in a vacuo or argon atmosphere, and then heat-treated at 400–900° C., thereby manufacturing a desired rare earth sintered magnet.

As for the above method, the pulverizing step is performed in a nitrogen or inert gas atmosphere so as to prevent magnetic properties of the manufactured magnet from reducing due to oxygen contamination.

Further, the rare earth powders are packed in a metal mold to have a density of 2.0–4.0 g/cc, so as to increase the degree of orientation of the powders.

In addition, the magnetic field is alternately applied 1–10 times in the range of 30–70 kOe, so as to increase the degree of orientation of the powders.

Also, a length of a magnetic material constituting punching parts of a longitudinal magnetic field compacting device is controlled 0–10 times depending on a powder-packing height, so as to change a compacting pressure in the pulse magnetic field of 30–70 kOe.

Referring to FIG. 1, there is illustrated the longitudinal magnetic field compacting device of the present invention. As shown in FIG. 1, the longitudinal magnetic field compacting device 10 comprises a nonmagnetic metal mold 2 having a cavity with a predetermined shape for uniformly packing rare earth powders therein. The nonmagnetic metal mold 2 is positioned in a central portion of a magnetic field coil part 3 that acts to apply a pulse magnetic field several times to the mold 2 to align the powders in the mold 2 in the direction of the applied magnetic field. Further, an upper punching part 1 and a lower punching part 4, both composed of a magnetic and nonmagnetic material, are disposed to come into close contact with a top and a bottom of the metal mold 2, respectively. A core 7 as a nonmagnetic material is disposed at a lower portion of the nonmagnetic metal mold 2, and a buffering spring 5 for fixing the position of the lower punching part 4 after compacting is positioned at a lower portion of the lower punching part 4. An air compressor 8 is connected to each of a first air cylinder 6 mounted above the upper punching part 1, a second air cylinder 5*a* mounted below the buffering spring 5, and third and fourth air cylinders 6*a* and 6*b* mounted to both lower ends of the metal mold 2. Thus, air is fed to each air cylinder to move the metal mold 2. Further, a magnetizer 9 is connected to the magnetic field coil part 3 for feeding a magnetic field power to the magnetic field coil part 3.

As for the operation of the longitudinal magnetic field compacting device 10, the nonmagnetic metal mold 2 outside the magnetic field coil part 3 is packed with the rare earth powders in a predetermined packing density range. Then, the powder-packed nonmagnetic metal mold 2 is positioned in the central portion of the magnetic field coil part 3. As such, the aligning and compacting processes of the packed powders may be continuously or simultaneously performed by the pulse magnetic field generated by use of the magnetizer 9 and the magnetic field coil part 3, to form a compacted body. Thereafter, the compacted body is removed from the metal mold 2 and placed outside the magnetic field coil part 3.

In such a case, the strength of the magnetic field generated and the lengths of the magnetic materials constituting the upper and lower punching parts 1 and 4 have an influence on the powder aligning and compacting pressure.

Thusly comprised longitudinal magnetic field compacting device is suitable for use in fabrication of the rare earth sintered magnet in the shape of a butterfly for VCM of HDD or DVD, a disk or coin for careless motor, and a block for linear motor.

The alloy having 27–36 wt % RE (rare earth element), 59–73 wt % Fe, 0–5 wt % TM (3d transition metal) and 0–2 wt % B is melted by a vacuum induction heating process, to obtain a molten alloy. Such a molten alloy is subjected to a strip casting process or a chill mold casting process, to prepare an alloy ingot, which is then hydrogenated in the range of room temperature to 200° C., to increase the pulverizability of the alloy ingot.

The hydrogenated alloy ingot is uniformly and finely pulverized to a particle size of 2–6 μm by the use of a jet mill, an attritor mill, a ball mill or a vibration mill, thus obtaining rare earth powders.

As such, the powder preparation is performed in a nitrogen or inert gas atmosphere, thereby preventing a reduction in magnetic properties due to oxygen contamination.

The rare earth powders are oriented using the pulse magnetic field, and are subjected to a longitudinal compacting process, based on the principle that a magnetic material is attracted to a center of a magnetic field coil by the pulse magnetic field. Thusly compacted body is sintered at 1000–1100° C. in a vacuo or argon atmosphere, and then heat-treated at 400–900° C., thereby manufacturing a desired rare earth sintered magnet. In such a case, the above manufacturing method of the magnet using the pulse magnetic field is advantageous by minimizing manufacturing costs.

Specifically, the rare earth powders are uniformly packed in the nonmagnetic metal mold 2 having a cavity with a predetermined shape, which is then positioned in the central portion of the magnetic field coil part 3. Then, the pulse magnetic field is applied several times to the metal mold 2 by means of the magnetic field coil part 3 in such a way that the powders in the metal mold 2 are aligned in the direction of the applied magnetic field. Thereafter, the upper and lower punching parts 1 and 4 made of magnetic and nonmagnetic materials come into close contact with the top and the bottom of the nonmagnetic metal mold 2, whereby the pulse magnetic field is further applied to the metal mold 2 to perform the magnetic field compacting process of the powders.

Meanwhile, upon the application of the pulse magnetic field, the magnetic material constituting the upper and lower punching parts 1 and 4 is subjected to a force attracting toward the central portion of the magnetic field coil part 3. Thus, even though a mechanical or hydraulic pressure is not additionally applied, it is possible to perform the pressure compacting process. The compacted body, resulting from the longitudinal compacting process under the pulse magnetic field, is sintered at 1000–1100° C. in a vacuo or argon atmosphere and heat-treated at 400–900° C., to give the rare earth magnet.

In order to increase the degree of orientation of the above compacted body, almost all the powders should be oriented along the direction of the magnetic field applied for powder alignment. Further, such a magnetic field is applied without interruption, and the degree of orientation of the powders is maintained at a predetermined level during the compacting process.

With the intention of changing the compacting pressure in the pulse magnetic field of 30–70 kOe, the length of the magnetic material constituting the punching parts is controlled 0–10 times depending on the height of the packing powders.

In addition, with a desire to increase the degree of orientation of the powders, the powders are packed in the metal mold to have a packing density of 2.0–4.0 g/cc, and the pulse magnetic field, serving as a magnetic field for powder alignment, is alternately applied 1–10 times in the range of 30–70 kOe. That is, the strength or the alternation times of the pulse magnetic field is increased, thereby realizing optimal magnetic properties. As such, the compacting density falls in the range of 2.5–3.0 g/cc.

For a change in the compacting density, the pulse magnetic field is varied in the range of 30–70 kOe, and the length of the magnetic material of the punching parts is controlled 0–10 times depending on the height of the packing powders. As a result, the compacted body having a compacting density of 3.0–4.0 g/cc can be manufactured.

Eventually, a rare earth magnet with excellent magnetic properties can be manufactured by the longitudinal pulse magnetic field compacting method of the present invention, which has lower manufacturing costs, compared to conventional longitudinal or transverse compacting methods using the static magnetic field.

Having generally described this invention, a further understanding can be obtained by reference to specific examples which are provided herein for the purposes of illustration only and are not intended to be limiting unless otherwise specified.

EXAMPLE 1

An alloy comprising 32 wt % Re-66 wt % Fe-1 wt % TM-1 wt % B (RE: rare earth element, TM: 3d transition metal) was melted by a vacuum induction heating process, to obtain a molten alloy, which was then subjected to a strip casting process, thus giving an alloy ingot. The alloy ingot was hydrogenated at 100° C., and pulverized to a particle size of 3.5 μm.

The pulverized rare earth powders were uniformly packed in a ring-shaped nonmagnetic metal mold 2 while meeting a packing density in the range of 2.0–4.0 g/cc. Then, the metal mold 2 was positioned in a central portion of a magnetic field coil part 3, after which a pulse magnetic field of 30 kOe was alternately applied five times to the metal mold 2 to align the powders in the mold 2 in the direction of an applied magnetic field. The aligned rare earth powders were subjected to a compacting process with the pulse magnetic field of 30 kOe being applied, to yield a compacted body. Such a compacted body was sintered at 1000–1100° C. in a vacuo or argon atmosphere, and then heat-treated at 400–900° C., to manufacture a desired magnet.

The magnet was measured for magnetic properties using a B-H loop tracer under the magnetic field of up to 20 kOe. The results are shown in Table 1, below.

That is, Table 1 shows the magnetic properties according to the packing density upon a longitudinal pulse magnetic field compacting of the alloy including the above composition.

TABLE 1

| | Sintered Density (g/cc) | Current Flux Density (kG) | Coercive Force (kOe) | Max. Magnetic Energy Product (MGOe) |
|---|---|---|---|---|
| Con. Longitudinal Static Magnetic Field Compacting 1 | 7.59 | 12.1 | 18.0 | 31.5 |
| Con. Transverse Static Magnetic Field Compacting 2 | 7.59 | 13.1 | 17.7 | 42.0 |
| Longitudinal Pulse Magnetic Field Compacting (packing density = 2.0 g/cc) | 7.60 | 12.8 | 17.5 | 41.2 |
| Longitudinal Pulse Magnetic Field Compacting (packing density = 2.25 g/cc) | 7.61 | 13.0 | 16.8 | 42.0 |
| Longitudinal Pulse Magnetic Field Compacting (packing density = 2.5 g/cc) | 7.60 | 13.1 | 16.9 | 42.6 |
| Longitudinal Pulse Magnetic Field Compacting (packing density = 2.75 g/cc) | 7.61 | 13.1 | 16.8 | 43.0 |
| Longitudinal Pulse Magnetic Field Compacting (packing density = 3.0 g/cc) | 7.60 | 13.1 | 16.6 | 42.7 |

TABLE 1-continued

| | Sintered Density (g/cc) | Current Flux Density (kG) | Coercive Force (kOe) | Max. Magnetic Energy Product (MGOe) |
|---|---|---|---|---|
| Longitudinal Pulse Magnetic Field Compacting (packing density = 3.25 g/cc) | 7.59 | 12.9 | 17.1 | 41.9 |
| Longitudinal Pulse Magnetic Field Compacting (packing density = 3.5 g/cc) | 7.59 | 12.9 | 17.5 | 41.3 |
| Longitudinal Pulse Magnetic Field Compacting (packing density = 4.0 g/cc) | 7.60 | 12.0 | 17.7 | 31.1 |

EXAMPLE 2

An alloy comprising 32 wt % RE-66 wt % Fe-1 wt % TM-1 wt % B (RE: rare earth element, TM: 3d transition metal) was melted by a vacuum induction heating manner, to obtain a molten alloy, which was then subjected to a strip casting process, yielding an alloy ingot. The alloy ingot was hydrogenated at 100° C., and pulverized to a particle size of 3.5 μm.

The pulverized rare earth powders were uniformly packed in a ring-shaped nonmagnetic metal mold 2 while meeting a packing density of 2.75 g/cc. Then, the metal mold 2 was positioned in a central portion of a magnetic field coil part 3, after which a pulse magnetic field of 30 kOe was alternately applied one to ten times to the metal mold 2 to align the powders in the metal mold 2 in the direction of an applied magnetic field. Then, the aligned powders were subjected to a compacting process with the application of the pulse magnetic field of 30 kOe, to prepare a compacted body. Such a compacted body was sintered at 1000–1100° C. in a vacuo or argon atmosphere, and then heat-treated at 400–900° C., to manufacture a desired magnet.

The magnet was measured for magnetic properties using a B-H loop tracer under the magnetic field of up to 20 kOe. The results are shown in Table 2, below.

That is, Table 2 shows the magnetic properties according to the alternation times of the pulse magnetic field applied for powder alignment upon a longitudinal pulse magnetic field compacting of the alloy including the above composition.

TABLE 2

| | Sintered Density (g/cc) | Current Flux Density (kG) | Coercive Force (kOe) | Max. Magnetic Energy Product (MGOe) |
|---|---|---|---|---|
| Longitudinal Pulse Magnetic Field Compacting (pulse alternation = 1 times) | 7.60 | 12.9 | 17.0 | 41.9 |
| Longitudinal Pulse Magnetic Field Compacting (pulse alternation = 3 times) | 7.60 | 13.0 | 16.6 | 42.5 |
| Longitudinal Pulse Magnetic Field Compacting (pulse alternation = 5 times) | 7.61 | 13.1 | 16.8 | 43.0 |
| Longitudinal Pulse Magnetic Field Compacting (pulse alternation = 7 times) | 7.61 | 13.2 | 16.8 | 43.5 |
| Longitudinal Pulse Magnetic Field Compacting (pulse alternation = 10 times) | 7.60 | 13.2 | 16.6 | 43.4 |

EXAMPLE 3

An alloy comprising 32 wt % RE-66 wt % Fe-1 wt % TM-1 wt % B (RE: rare earth element, TM: 3d transition metal) was melted by a vacuum induction heating manner, to obtain a molten alloy, which was then subjected to a strip casting process, to prepare an alloy ingot. The alloy ingot was hydrogenated at 100° C., and pulverized to a particle size of 3.5 μm.

The pulverized rare earth powders were uniformly packed in a ring-shaped nonmagnetic metal mold 2 while meeting a packing density of 2.75 g/cc. Then, the metal mold 2 was positioned in a central portion of a magnetic field coil part 3, after which a pulse magnetic field of 30 kOe was alternately applied seven times to the metal mold 2 to align the powders in the metal mold 2 in the direction of the applied magnetic field. While the pulse magnetic field was varied in the range of 20–40 kOe and the length of the magnetic material constituting punching parts was controlled 0–10 times depending on the height of the packing powders, a compacting process was performed to obtain a compacted body having a compacting density of 3.5–4.0 g/cc. The compacted body was sintered at 1000–1100° C. in a vacuo or argon atmosphere, and then heat-treated at 400–900° C., to manufacture a magnet.

The magnet was measured for magnetic properties using a B-H loop tracer under the magnetic field of up to 20 kOe. The results are shown in Table 3, below.

That is, Table 3 shows the magnetic properties according to the compacting density upon a longitudinal pulse magnetic field compacting of the alloy including the above composition.

TABLE 3

| | Sintered Density (g/cc) | Current Flux Density (kG) | Coercive Force (kOe) | Max. Magnetic Energy Product (MGOe) |
|---|---|---|---|---|
| Longitudinal Pulse Magnetic Field Compacting (compacting density = 3.5 g/cc) | 7.60 | 13.3 | 16.6 | 44.1 |
| Longitudinal Pulse Magnetic Field Compacting (compacting density = 3.6 g/cc) | 7.60 | 13.3 | 16.7 | 44.0 |
| Longitudinal Pulse Magnetic Field Compacting (compacting density = 3.7 g/cc) | 7.59 | 13.2 | 16.5 | 43.6 |
| Longitudinal Pulse Magnetic Field Compacting (compacting density = 3.8 g/cc) | 7.61 | 13.2 | 16.8 | 43.5 |
| Longitudinal Pulse Magnetic Field Compacting (compacting density = 4.0 g/cc) | 7.60 | 13.2 | 16.9 | 43.5 |

EXAMPLE 4

An alloy comprising 30 wt % RE-66 wt % Fe-1 wt % TM-1 wt % B (RE: rare earth element, TM: 3d transition metal) was melted by a vacuum induction heating manner, to obtain a molten alloy, which was then subjected to a strip casting process, to prepare an alloy ingot. The alloy ingot was hydrogenated at 100° C., and pulverized to a particle size of 3.5 μm.

The pulverized rare earth powders were uniformly packed in a ring-shaped nonmagnetic metal mold 2 while meeting a packing density of 2.75 g/cc. Then, the metal mold 2 was positioned in a central portion of a magnetic field coil part 3, after which a pulse magnetic field of 70 kOe was alternately applied seven times to the metal mold 2 to align the powders in the metal mold 2 in the direction of an applied magnetic field. While the pulse magnetic field of 30 kOe was applied, the rare earth powders were subjected to a compacting process, to produce a compacted body. Such a compacted body was sintered at 1000–1100° C. in a vacuo or argon atmosphere, and then heat-treated at 400–900° C., to manufacture a magnet.

The magnet was measured for magnetic properties using a B-H loop tracer under the magnetic field of up to 20 kOe. The results are shown in Table 4, below.

That is, Table 4 shows the magnetic properties according to the component of the magnet upon a longitudinal pulse magnetic field compacting of the alloy including the above composition.

TABLE 4

| | Sintered Density (g/cc) | Current Flux Density (kG) | Coercive Force (kOe) | Max. Magnetic Energy Product (MGOe) |
|---|---|---|---|---|
| Longitudinal Static Magnetic Field Compacting | 755 | 13.2 | 10.2 | 43.5 |
| Longitudinal Pulse Magnetic Field Compacting | 755 | 14.2 | 9.5 | 50.1 |

Using the longitudinal pulse magnetic field compacting method and device, the rare earth magnet having high performance can be manufactured in a butterfly shape for use in VCM of HDD or DVD, disk or coin shape for coreless motors and block shape for linear motors. As well, other rare earth magnets can be manufactured.

As described above, the present invention provides a longitudinal magnetic field compacting method and device for manufacturing rare earth magnets. Such a magnet is in the shape of a butterfly for use in VCM of HDD or DVD, a disk or coin for coreless motors, and a block for linear motors. As for the method of the present invention, since a compacted body has the same shape as end products, there is no additional processing cost, thus minimizing manufacturing costs, compared to conventional longitudinal compacting methods using a static magnetic field. Under a high pulse magnetic field of 50–70 kOe, rare earth powders are aligned and simultaneously can be subjected to a longitudinal compacting. Thereby, the rare earth magnet has magnetic properties of 42–50 MGOe better than those fabricated by conventional transverse static magnetic field compacting methods. Accordingly, the efficiencies of the longitudinal magnetic field compacting method and device of the present invention are improved, thus obtaining high practical applicability.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A longitudinal magnetic field compacting method for manufacturing a rare earth magnet in the shape of a butterfly for use in VCM of HDD or DVD, a disk or coin for use in coreless motors, and a block for linear motors, comprising the following steps of:

melting an alloy including 27–36 wt % RE/59–73 wt % Fe/0–5 wt % TM/0–2 wt % B by a vacuum induction heating process, to obtain a molten alloy, which is then subjected to a strip casting process or a chill mold casting process, to prepare an alloy ingot;

hydrogenating the alloy ingot in a range of room temperature to 200° C. to increase pulverizability of the alloy ingot;

pulverizing the alloy ingot by means of a jet mill, an attritor mill, a ball mill or a vibration mill, to prepare rare earth powders having a particle size of 2–6 μm;

applying a pulse magnetic field to the rare earth powders so that the rare earth powders are oriented in a direction of an applied magnetic field and subjected to a longitudinal magnetic field compacting, based on the principle that a magnetic material is attracted to a center of a magnetic field coil by the pulse magnetic field, to form a compacted body;

sintering the compacted body at 1000–1100° C. in a vacuo or argon atmosphere, to prepare a sintered body; and heat-treating the sintered body at 400–900° C., thereby obtaining a rare earth magnet.

2. The method as defined in claim 1, wherein the pulverizing step is performed in a nitrogen atmosphere or an inert gas atmosphere so as to prevent magnetic properties of the rare earth magnet from reducing due to oxygen contamination.

3. The method as defined in claim 1, wherein the rare earth powders are packed in a metal mold to have a packing density of 2.0–4.0 g/cc, increasing the degree of orientation of the powders.

4. A longitudinal magnetic field compacting method for manufacturing a rare earth magnet, comprising the steps of:

melting an alloy comprising about 27–36 wt % RE/ about 59–73 wt % Fe/ about 0–5 wt % TM/ about 0–2 wt % B by a vacuum induction heating process, to obtain a molten alloy, which is then subjected to a casting process, to prepare an alloy ingot;

hydrogenating the alloy ingot in a temperature range of about room temperature to about 200° C.;

pulverizing the alloy ingot, to prepare a rare earth powder;

applying a pulse magnetic field to the rare earth powders, to form a compacted body;

sintering the compacted body at about 1000 to about 1100° C. in a vacuo or argon atmosphere, to prepare a sintered body; and heat-treating the sintered body at about 400 to about 900° C., thereby obtaining a rare earth magnet.

5. A longitudinal magnetic field compacting method according to claim 4 wherein said magnetic field is alternately applied 2–10 times.

6. A longitudinal magnetic field compacting method according to claim 5 wherein said magnetic field is in the range of about 30–70 kOe.

7. A longitudinal magnetic field compacting method according to claim 4 wherein said magnetic field is in the range of about 30–70 kOe.

8. A longitudinal magnetic field compacting method according to claim 4 wherein said alloy ingot is pulverized to prepare a rare earth powder having a particle size of about 2 to about 6 μm.

9. A longitudinal magnetic field compacting method according to claim 4 wherein said compacting method is performed in a compacting device comprising upper and lower punching parts, and at least one of said upper and lower punching parts are actuated about one to about ten times.

10. The method as defined in claim 4, wherein the pulverizing step is performed in a nitrogen atmosphere or an inert gas atmosphere so as to prevent magnetic properties of the rare earth magnet from reducing due to oxygen contamination.

11. The method as defined in claim 4, wherein the rare earth powders are packed in a metal mold to have a packing density of 2.0–4.0 g/cc, increasing the degree of orientation of the powders.

12. A longitudinal magnetic field compacting method for manufacturing a rare earth magnet, comprising the following steps of:

melting an alloy comprising about 27–36 wt % RE/ about 59–73 wt % Fe/ about 0–5 wt % TM/ about 0–2 wt % B by a vacuum induction heating process, to obtain a molten alloy, which is then subjected to a casting process, to prepare an alloy ingot;

hydrogenating the alloy ingot in a range of about room temperature to about 2000° C.;

pulverizing the alloy ingot, to prepare a rare earth powder;

applying a pulse magnetic field to the rare earth powders, to form a compacted body;

sintering the compacted body at about 1000 to about 1100° C. in a vacuo or argon atmosphere, to prepare a sintered body; and heat-treating the sintered body at about 400 to about 900° C., thereby obtaining a rare earth magnet;

wherein said compacting method is performed in a compacting device comprising upper and lower punching parts, and at least one of said upper and lower punching parts are actuated about one to about ten times.

* * * * *